US009556394B2

(12) United States Patent
Khelidj et al.

(10) Patent No.: US 9,556,394 B2
(45) Date of Patent: Jan. 31, 2017

(54) NATURAL AND SYNTHETIC ESTER-CONTAINING LUBRICANTS HAVING ENHANCED HYDROLYTIC STABILITY

(75) Inventors: Nadjet Khelidj, Zurich (CH); Martin R. Greaves, Hirzel (CH); Evelyn A. Zaugg-Hoozemans, Horgen (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 14/118,683

(22) PCT Filed: Jun. 8, 2012

(86) PCT No.: PCT/US2012/041452

§ 371 (c)(1),
(2), (4) Date: Nov. 19, 2013

(87) PCT Pub. No.: WO2012/173878

PCT Pub. Date: Dec. 20, 2012

(65) Prior Publication Data

US 2014/0107004 A1 Apr. 17, 2014

Related U.S. Application Data

(60) Provisional application No. 61/496,960, filed on Jun. 14, 2011.

(51) Int. Cl.

| | |
|---|---|
| ***C10M 135/04*** | (2006.01) |
| ***C10M 137/10*** | (2006.01) |
| ***C10M 169/04*** | (2006.01) |
| ***C10M 105/36*** | (2006.01) |
| ***C10M 173/02*** | (2006.01) |
| ***C10M 129/08*** | (2006.01) |
| ***C10M 145/26*** | (2006.01) |

(52) U.S. Cl.

CPC ..... *C10M 129/08* (2013.01); *C10M 145/26* (2013.01); *C10M 169/041* (2013.01); *C10M 2207/2835* (2013.01); *C10M 2207/301* (2013.01); *C10M 2207/401* (2013.01); *C10M 2209/10* (2013.01); *C10M 2209/103* (2013.01); *C10M 2209/104* (2013.01); *C10M 2223/043* (2013.01); *C10N 2230/66* (2013.01); *C10N 2240/08* (2013.01)

(58) Field of Classification Search

CPC ..... C10M 2209/1013; C10M 2209/1033; C10M 2209/1075; C10M 2207/2805; C10M 2207/401; C10M 2207/026; C10M 2223/041

USPC ..... 508/322, 370, 385, 532, 440, 496, 437, 508/462

See application file for complete search history.

(56) References Cited

U.S. PATENT DOCUMENTS

| | | | | |
|---|---|---|---|---|
| 5,358,652 | A | 10/1994 | Macpherson | |
| 2006/0128816 | A1 | 6/2006 | Cheng et al. | |
| 2006/0193802 | A1 | 8/2006 | Lysenko et al. | |
| 2008/0312113 | A1* | 12/2008 | Beatty | C10M 107/34 508/162 |
| 2009/0156446 | A1* | 6/2009 | McAtee | C10M 141/10 508/306 |
| 2010/0105803 | A1* | 4/2010 | Bingeman | 523/122 |

FOREIGN PATENT DOCUMENTS

| | | |
|---|---|---|
| EP | 0420497 | 4/1991 |
| EP | 0568038 | 11/1993 |
| WO | 9826024 | 6/1998 |
| WO | 2008079304 | 7/2008 |

OTHER PUBLICATIONS

European Response to Office Action dated Feb. 13, 2014 filed Aug. 14, 2014 for counterpart European Application No. 12727748.1 filed Aug. 14, 2014, 24 pages.
EP Office Action dated Feb. 13, 2014; from EP counterpart Application No. 12727748.1.
Instructions to EP Office Action dated Jul. 14, 2014; from EP counterpart Application No. 12727748.1.
PCT/US2012/041452 Search Report and Written Opinion dated Aug. 16, 2012.
PCT/US2012/041452 International Preliminary Report on Patentability dated Jan. 3, 2014.
Chinese Office Action dated Sep. 5, 2014 for counterpart Chinese Application No. 201280029157.6 with Associate letter, 11 pages.
Chinese Response to Office Action Jan. 20, 2015; from Chinese counterpart Application No. 201280029157.6.
EPO Office Action dated Feb. 17, 2015 for counterpart EPO Application No. 12727748.1, 5 pages.
Chinese Second Office Action dated Apr. 7, 2015 for counterpart Chinese Application No. 2012800291576, 5 pages.
Response to European Patent Office Action dated Feb. 17, 2015 filed Jul. 30, 2015 for counterpart European Application No. 12727748.1, 9 pages.
Japanese Application 11-222598 dated Aug. 17, 1999, abstract and machine translation, 10 pages.
Japanese Application No. 2005-054063 dated Mar. 3, 2005, abstract and machine translation, 33 pages.
Japanese Office Action dated Jan. 19, 2016; for counterpart Japanese Application No. 2014-515884, 3 pages.

* cited by examiner

*Primary Examiner* — Vishal Vasisth
(74) *Attorney, Agent, or Firm* — Brooks, Cameron & Huebsch, PLLC

(57) ABSTRACT

A lubricant composition comprising (a) from 0.1 to 10 percent by weight of one or more polyalkylene glycols (PAG); and (2) one or more ester base oils selected from the group of natural esters, synthetic esters and combinations thereof; wherein the one or more PAG has a molecular weight in the range 1500 to 5000 g/mole, comprises from 10 to 40 percent by weight of units derived from ethylene oxide and from 90 to 60 percent by weight of units derived from propylene oxide; and wherein the one or more PAGs are in the form of block copolymer, reverse block copolymer or combinations thereof is provided. Also provided is a method of enhancing the hydrolytic stability of an ester base oil.

15 Claims, No Drawings

NATURAL AND SYNTHETIC ESTER-CONTAINING LUBRICANTS HAVING ENHANCED HYDROLYTIC STABILITY

This application is a 371 of PCT/US2012/041452, filed Jun. 8, 2012 which claims benefit of 61/496,960, filed Jun. 14, 2011.

FIELD OF INVENTION

The invention relates to an ester-based lubricant composition which exhibits enhanced hydrolytic stability and to a method of enhancing the hydrolytic stability of ester based lubricants.

BACKGROUND OF THE INVENTION

Synthetic and natural ester based lubricants are used in a large number of applications including, for example, automotive and aviation oils, refrigeration oils, metal working fluids, gear oils, turbo oils, hydraulic fluids and refrigeration lubricants.

Synthetic and natural ester based lubricants, however, are well known to be very sensitive to the effects of water. Hydrolysis of such lubricants can substantially shorten the lubricant life and lead to a higher risk of equipment failure. Further, it is known in the art that inclusion of anti-wear additives in ester base oils can accelerate the hydrolytic degradation of esters due to their acidic nature. Thus, at least one common additive exacerbates the hydrolytic instability of ester base oils.

Several approaches have been taken to increase the hydrolytic stability of ester based lubricants. In one approach, additives, such as dicarbo-imides, are included in various amounts to minimize ester hydrolysis. In another approach, esters having a significant level of steric hindrance around the ester functionality have been used to minimize ester hydrolysis. Neither approach has satisfactorily solved the problem ester based lubricant hydrolytic stability.

SUMMARY OF THE INVENTION

The instant invention is a lubricant composition and a method of enhancing the hydrolytic stability of an ester based lubricant.

In one embodiment, the instant invention provides a lubricant composition comprising: (a) from 0.1 to 10 percent by weight of one or more polyalkylene glycols (PAGs); and (2) one or more ester base oils selected from the group of natural esters, synthetic esters and combinations thereof; wherein the one or more PAGs have a molecular weight in the range 1500 to 5000 g/mole, comprise from 10 to 40 percent by weight of units derived from ethylene oxide and from 90 to 60 percent by weight of units derived from propylene oxide; and wherein the one or more PAGs are in the form of block copolymer, reverse block copolymer or combinations thereof.

In an alternative embodiment, the instant invention further provides a method of enhancing the hydrolytic stability of an ester based lubricant comprising: (a) providing an ester base oil; (b) adding to the ester base oil from 0.1 to 10 percent by weight one or more PAGs wherein the one or more PAGs have a molecular weight in the range 1500 to 5000 g/mole, comprise from 10 to 40 percent by weight of units derived from ethylene oxide and from 90 to 60 percent by weight of units derived from propylene oxide; and wherein the one or more PAG is in the form of block copolymer, reverse block copolymer or combinations thereof; and (c) blending the one or more PAGs to form a lubricant composition.

In an alternative embodiment, the instant invention provides a lubricant composition and method of enhancing the hydrolytic stability of an ester based lubricant, in accordance with any of the preceding embodiments, except that the one or more ester base oils is one or more natural esters selected from the group consisting of vegetable oils.

In an alternative embodiment, the instant invention provides a lubricant composition and method of enhancing the hydrolytic stability of an ester based lubricant, in accordance with any of the preceding embodiments, except that the one or more ester base oils is one or more natural esters selected from the group consisting soy oil, canola oil, and sunflower oil.

In an alternative embodiment, the instant invention provides a lubricant composition and method of enhancing the hydrolytic stability of an ester based lubricant, in accordance with any of the preceding embodiments, except that the one or more ester base oils include from greater than 0 to 100 percent by weight of ester derived from a renewable resource.

In an alternative embodiment, the instant invention provides a lubricant composition and method of enhancing the hydrolytic stability of an ester based lubricant, in accordance with any of the preceding embodiments, except that the one or more esters is one or more synthetic esters selected from the group consisting of polyol esters and dicarbonic acid esters.

In an alternative embodiment, the instant invention provides a lubricant composition and method of enhancing the hydrolytic stability of an ester based lubricant, in accordance with any of the preceding embodiments, except that the lubricant composition further comprises one or more selected from the group of antioxidants, anti-wear additives and corrosion inhibitors.

In an alternative embodiment, the instant invention provides a lubricant composition and method of enhancing the hydrolytic stability of an ester based lubricant, in accordance with any of the preceding embodiments, except that the antioxidants are selected from the group consisting of phenolic antioxidants, hindered phenolic antioxidants, aromatic amine antioxidants, secondary amine antioxidants, sulfurized phenolic antioxidants, sulfurized olefins, oil-soluble copper compounds, and combinations thereof.

In an alternative embodiment, the instant invention provides a lubricant composition and method of enhancing the hydrolytic stability of an ester based lubricant, in accordance with any of the preceding embodiments, except that the corrosion inhibitors are selected from the group consisting of (1) amine salts of an aliphatic phosphoric acid ester; (2) alkenyl succinic acid half esters; (3) amine salts of an alkyl phosphoric acid combined with a dithiophosphoric acid derivative; (4) combinations of barium dinonylnaphthalene sulfonate and dinonylnaphthalene carboxylate in a hydrotreated naphthenic oil; and (5) combinations thereof.

In an alternative embodiment, the instant invention provides a lubricant composition and method of enhancing the hydrolytic stability of an ester based lubricant, in accordance with any of the preceding embodiments, except that the anti-wear additives are selected from the group consisting of zinc dialkyldithiophosphates, tricresyl phosphate, didodecyl phosphite, sulfurized sperm oil, sulfurized terpenes, zinc dialkyldithiocarbamate, and combinations thereof.

In an alternative embodiment, the instant invention provides a lubricant composition and method of enhancing the hydrolytic stability of an ester based lubricant, in accordance with any of the preceding embodiments, except that the one or more PAGs each have a molecular weight from 1700 to 3300 g/mole.

In an alternative embodiment, the instant invention provides a lubricant composition and method of enhancing the hydrolytic stability of an ester based lubricant, in accordance with any of the preceding embodiments, except that the one or more PAGs are present in an amount from 5 to 10 percent by weight.

In an alternative embodiment, the instant invention provides a lubricant composition and method of enhancing the hydrolytic stability of an ester based lubricant, in accordance with any of the preceding embodiments, except that the one or more PAGs has an amount of units derived from EO from 20 to 40 percent by weight.

DETAILED DESCRIPTION

The instant invention is a lubricant composition and a method of improving the hydrolytic stability of a natural or synthetic lubricant composition.

The lubricant composition according to the present invention comprises (a) from 0.1 to 10 percent by weight of one or more polyalkylene glycols (PAG); and (2) one or more ester base oils selected from the group of natural esters and synthetic esters; wherein the one or more PAG has a molecular weight in the range 1500 to 5000 g/mole, comprises from 10 to 40 percent by weight of units derived from ethylene oxide and from 90 to 60 percent by weight of units derived from propylene oxide; and wherein the one or more PAG is in the form of block copolymer, reverse block copolymer or combinations thereof.

The PAGs useful in the present invention may be present in any amount from 0.1 to 10 percent by weight based on the total weight of the PAG and ester base oil(s). All individual values and subranges from 1 to 10 wt % are included herein and disclosed herein; for example, the total PAG may be present in an amount from a lower limit of 0.1, 0.5, 1, 2, 3, 4, 5, 6, 7, 8, or 9 wt % to an upper limit of 2, 3, 4, 5, 6, 7, 8, 9, or 10 wt %. For example, the total amount of PAG may be in the range of from 0.1 to 10 wt %, or in the alternative, the total amount of PAG may be in the range of from 3 to 9 wt %, or in the alternative, the total amount of PAG may be in the range of from 5 to 9 wt %, or in the alternative, the total amount of PAG may be in the range of from 5 to 10 wt %, or in the alternative, the total amount of PAG may be in the range of from 6 to 9 wt %.

The one or more PAG useful in embodiments of the present invention have a molecular weight in the range 1500 to 5000 g/mole. All individual values and subranges from 1500 to 5000 g/mole are included herein and disclosed herein; for example, the molecular weight can be from a lower limit of 1500, 2000, 2500, 3000, 3500, 4000, or 4500 g/mole to an upper limit of 2000, 2500, 3000, 3500, 4000, 4500, or 5000 g/mole. For example, the PAG molecular weight may be in the range of from 1500 to 5000 g/mole, or in the alternative, the PAG molecular weight may be in the range of from 2000 to 5000 g/mole, or in the alternative, the PAG molecular weight may be in the range of from 3000 to 4800 g/mole, or in the alternative, the PAG molecular weight may be in the range of from 3500 to 5000 g/mole, or in the alternative, the PAG molecular weight may be in the range of from 2000 to 4000 g/mole.

The one or more PAG useful in embodiments of the present invention comprise from 10 to 40 percent by weight of units derived from ethylene oxide (EO). All individual values and subranges from 10 to 40 percent by weight are included herein and disclosed herein; for example, the amount of units derived from EO in the PAG can be from a lower limit of 10, 13, 17, 21, 25, 29, 33, or 39 percent by weight to an upper limit of 14, 18, 22, 26, 30, 34, 38 or 40 percent by weight. For example, the amount of units derived from EO in the PAG may be in the range of from 10 to 40 percent by weight, or in the alternative, the amount of units derived from EO in the PAG may be in the range of from 23 to 30 percent by weight, or in the alternative, the amount of units derived from EO in the PAG may be in the range of from 19 to 38 percent by weight, or in the alternative, the amount of units derived from EO in the PAG may be in the range of from 25 to 40 percent by weight, or in the alternative, the amount of units derived from EO in the PAG may be in the range of from 30 to 40 percent by weight.

The one or more PAG useful in embodiments of the present invention comprise from 60 to 90 percent by weight of units derived from propylene oxide (PO). All individual values and subranges from 60 to 90 percent by weight are included herein and disclosed herein; for example, the amount of units derived from PO in the PAG can be from a lower limit of 60, 65, 70, 75, 80 or 85 percent by weight to an upper limit of 65, 70, 75, 80, 85 or 90 percent by weight. For example, the amount of units derived from PO in the PAG may be in the range of from 60 to 90 percent by weight, or in the alternative, the amount of units derived from PO in the PAG may be in the range of from 70 to 77 percent by weight, or in the alternative, the amount of units derived from PO in the PAG may be in the range of from 62 to 81 percent by weight, or in the alternative, the amount of units derived from PO in the PAG may be in the range of from 60 to 75 percent by weight, or in the alternative, the amount of units derived from PO in the PAG may be in the range of from 60 to 70 percent by weight.

Polyalkylene glycol (PAG) polymers useful in the invention comprise units derived from ethylene oxide and propylene oxide to form block or reverse block copolymers. As used herein the term block copolymer refers to copolymers made by feeding a block of PO onto an initiator followed by a block of EO. As used herein the term reverse block copolymer refers to copolymers made by feeding a block of EO onto an initiator followed by a block of PO. An initiator is a chemical that has a labile hydrogen atom that can react with the oxides. Typical initiators include alcohols such as butanol and 2-ethylhaxanol. These are often called "monols" since they have one hydroxyl group that can be alkoxylated. Glycols are also used as initiators for example monoethylene glycol or monopropylene glycol. These contain two labile hydrogens and are often referred to as "diols," Tri-functional initiators such as glycerol or trimethylolpropane (TMP) are also used and are referred to as "Triols." In addition other initiators with labile hydrogens such as fatty acids (e.g. R—COOH) or amines (e.g. RNH2) can also be used.

Ester base oils useful in embodiments of the present invention include synthetic oils, natural oils, and combinations thereof.

In some embodiments of the inventive lubricant composition, the one or more ester base oils is one or more natural esters selected from the group consisting of vegetable seed oils. U.S. Patent Application Publication 2006/0193802 (Lysenko et al.), the relevant teachings of which are incorporated herein by reference, lists illustrative plant and vegetable seed oils in paragraph [0030]. Such oils include palm oil, palm kernel oil, castor oil, soybean oil, olive oil, peanut oil, rapeseed oil, corn oil, sesame seed oil, cottonseed oil, canola oil, safflower oil, linseed oil, sunflower oil; high oleic oils (e.g. an oleic acid content of from about 70 wt % to 90 wt %, based upon total oil weight) such as high oleic sunflower oil, high oleic safflower oil, high oleic corn oil, high oleic rapeseed oil, high oleic soybean oil and high oleic cottonseed oil; genetically-modified variations of oils noted in this paragraph, and mixtures thereof.

In certain specific embodiments of the inventive lubricant composition, the one or more ester base oils is one or more natural esters selected from the group consisting soy oil, canola oil (also known as rapeseed oil), and sunflower oil and castor oil In alternative embodiments of the inventive lubricant composition, the base oil includes from greater than 0 to 100 percent by weight of ester derived from a renewable resource. All individual values and subranges from greater than 0 to 100 percent by weight are included herein and disclosed herein; for example, the amount of ester derived from a renewable resource in the base oil can be from a lower limit of 1, 20, 38, 55, 62, 79, 87, or 96 percent by weight to an upper limit of 5, 28, 39, 45, 58, 66, 79, 88, 95 or 100 percent by weight. For example, the amount of ester derived from a renewable resource in the base oil may be in the range of from 1 to 100 percent by weight, or in the alternative, the amount of ester derived from a renewable resource in the base oil may be in the range of from 20 to 80 percent by weight, the amount of ester derived from a renewable resource in the base oil may be in the range of from 20 to 60 percent by weight, the amount of ester derived from a renewable resource in the base oil may be in the range of from 10 to 40 percent by weight, the amount of ester derived from a renewable resource in the base oil may be in the range of from 15 to 65 percent by weight. As used herein, the term renewable resource refers to resources such as seed oils and vegetable oils as distinguished from non-renewable resources, such as petroleum or natural gas.

In some embodiments of the inventive lubricant composition, the one or more ester base oils is one or more synthetic esters selected from the group consisting of a polyhydric alcohol and a $C_6$-$C_{22}$ acid (acid with six to 22 carbon atoms). Preferred polyhydric alcohols include at least one of trimethylolpropane, neopentylglycol, pentaerythritol, and 1,2,3-trihydroxy-propanol.

Additives may be used for a variety of purpose in lubricants. Certain embodiments of the inventive lubricant composition may include one or more additives selected from the group of antioxidants, anti-wear additives and corrosion inhibitors. Exemplary antioxidants useful in various embodiments of the inventive lubricant composition include phenolic antioxidants, hindered phenolic antioxidants, aromatic amine antioxidants, secondary amine antioxidants, sulfurized phenolic antioxidants, sulfurized olefins, oil-soluble copper compounds, and combinations thereof. Exemplary corrosion inhibitors useful in various embodiments of the inventive lubricant composition include: (1) an amine salt of an aliphatic phosphoric acid ester (for example, NALUBE 6110, available from King Industries); (2) an alkenyl succinic acid half ester in mineral oil (for example, IRGACOR L12, available from BASF Corporation); (3) an amine salt of an alkyl phosphoric acid combined with a dithiophosphoric acid derivative (for example, NALUBE 6330, available from King Industries); (4) a combination of barium dinonylnaphthalene sulfonate and dinonyl naphthalene carboxylate in a hydrotreated naphthenic oil (for example, NASUL BSN, available from King Industries); and (5) combinations thereof. Exemplary anti-wear additives useful in various embodiments of the inventive lubricant composition include zinc dialkyldithiophosphates, tricresyl phosphate, didodecyl phosphite, sulfurized sperm oil, sulfurized terpenes, zinc dialkyldithiocarbamate, and combinations thereof. Typical additive packages include antioxidants and corrosion inhibitors such as a combination of (4-nonlyphenol)acetic acid, a proprietary acylsarkosinate and nonyl phenol (IRGACOR L17), N-phenyl-ar-(1,1,3,3-tetramethylbutyl)-1-naphthaleneamine (IRGANOX L06), a reaction product of N-phenylbenzenamine with 2,4,4-trimethylpentent diphenylamine (IRGANOX L57), tolyltriazole and monomethyl hydroquinone. IRGANOX and IRGACOR may be obtained from the BASF Corporation. Yet other additives which may be used in lubricants include defoamers such as polymethylsiloxanes, demulsifiers, copper corrosion inhibitors, rust inhibitors, pour point depressants, detergents, dyes, metal deactivators, supplemental friction modifiers, diluents, combinations thereof, and the like. Additives may be used in any convenient combination or amount but typically comprise from 0.05 wt % to 5 wt %, preferably from 1 wt % to 3 wt %, of the total composition.

In an alternative embodiment, the instant invention further provides a method of enhancing the hydrolytic stability of an ester based lubricant comprising: (a) providing an ester base oil; (b) adding to the ester base oil from 0.1 to 10 percent by weight one or more PAGs wherein the one or more PAGs have a molecular weight in the range 1500 to 5000 g/mole, comprise from 10 to 40 percent by weight of units derived from ethylene oxide and from 90 to 60 percent by weight of units derived from propylene oxide; and wherein the one or more PAG is in the form of block copolymer, reverse block copolymer or combinations thereof; and (c) blending the one or more PAGs to form a lubricant composition.

Ester base oils useful in embodiments of the inventive method are as discussed above. Likewise, PAGs useful in embodiments of the inventive method are as discussed previously herein.

In some embodiments of the inventive method, one or more additives selected from the group consisting of antioxidants, anti-wear additives and corrosion inhibitors are added to the lubricant composition.

EXAMPLES

The following examples illustrate the present invention but are not intended to limit the scope of the invention. The examples of the instant invention demonstrate that inclusion of specific PAG block copolymer structures into the ester composition significantly improve the hydrolytic stability of the resultant lubricant composition.

Table 1 lists the components used in preparing the inventive and comparative lubricant compositions.

TABLE 1

| Name | Available from | Description |
|---|---|---|
| SYNATIVE ES TMTC | Cognis (BASF) | Saturated ester from trimethylol propane reacted with C8/C10 acid mix |

TABLE 1-continued

| Name | Available from | Description |
|---|---|---|
| SSR ULTRA COOLANT | The Dow Chemical Company (Dow) | Fully formulated rotary screw air compressor lubricant, Inhibited polypropylene glycol/pentaerythritol ester blend which contains an additive package at <8%. |
| SYMBIO PB-46 - Batch 1 | Dow | Estolide base oil formed from oligomerization of 12-Hydroxymethylstearate, then transesterified with 2-Ethylhexanol, then capped with an iso-butyric anhydride. Its total acid number was 0.09 mgKOH/g |
| SYMBIO PB-46 - Batch 2 | Dow | Estolide base oil formed from oligomerization of 12-Hydroxymethylstearate, then transesterified with 2-Ethylhexanol, then capped with an iso-butyric anhydride. Its total acid number was 0.19 mgKOH/g |
| Canola HILO | The Dow Chemical Company (Dow Agroscience) (DAS) | Canola oil (a high oleic containing canola oil in which the oleic content is 70-75%) |
| Sunflower oil | Commercially available from the Swiss super-market store Denner under the name Sonnenblumen Olie | Natural Sunflower oil containing 20-40% oleic acid and 50-70% linoleic acid fractions |
| Sunflower oil HILO | DAS | Sunflower oil (A high oleic containing canola oil in which the oleic content is >80%) |
| SYNALOX 100-30B | Dow | Butanol initiated PO-homopolymer with an average molecular weight of 850 g/mole |
| SYNALOX 50-30B | Dow | Butanol initiated 50/50 w/w* PO/EO random copolymer with an average molecular weight of 1000 g/mole |
| SYNALOX 80-130B | Dow | Butanol initiated 85/15 w/w PO/EO random copolymer with an average molecular weight of 2500 g/mole |
| DOWFAX 63N10 | Dow | Diol initiated 60 to 90/10 to 40 w/w PO/EO block copolymer, with an average molecular weight of 1700 g/mole |
| DOWFAX 63N30 | Dow | Diol initiated 60 to 90/10 to 40 w/w PO/EO block copolymer, with an average molecular weight of 2500 g/mole |
| DOWFAX 63N40 | Dow | Diol initiated 60 to 90/10 to 40 w/w PO/EO block copolymer, with an average molecular weight of 2400 g/mole |
| DOWFAX 81N10 | Dow | Diol initiated 60 to 90/10 to 40 w/w PO/EO block copolymer, with an average molecular weight of 2800 g/mole |
| DOWFAX 81N13 | Dow | Diol initiated 60 to 90/10 to 40 w/w PO/EO block copolymer, with an average molecular weight of 2600 g/mole |
| DOWFAX 81N15 | Dow | Diol initiated 60 to 90/10 to 40 w/w PO/EO block copolymer with an average molecular weight of 2900 g/mole |
| DOWFAX DF-111 | Dow | Triol initiated PO/EO reverse block copolymer, with an average molecular weight of 4800 g/mole |
| DOWFAX DF-112 | Dow | Triol initiated PO/EO reverse block copolymer, with an average molecular weight of 3600 g/mole |
| DOWFAX DF-114 | Dow | Triol initiated PO/EO reverse block copolymer, with an average molecular weight of 4800 g/mole |
| DOWFAX DF-117 | Dow | Triol initiated PO/EO block copolymer, with an average molecular weight of 4400 g/mole |
| DOWFAX 92N20 | Dow | Diol initiated 60 to 90/10 to 40 w/w PO/EO block copolymer with an average molecular weight of 3300 g/mole |
| DOWFAX 92N40 | Dow | Diol initiated 1 to 59/41 to 99 w/w PO/EO block copolymer with an average molecular weight of 3700 g/mole |
| DOWFAX 100N15 | Dow | Diol initiated 84/16 w/w PO/EO block copolymer with an average molecular weight of 3300 g/mole |
| PLURONIC RPE 2525 | BASF | EO/PO (75/25 w/w) Block copolymer |
| NALUBE AW-6110 | King Industries, Inc. | Amine salts of aliphatic phosphoric acid ester (used as an anti-wear additive) |

*The term "X/Y w/w PO/EO" means a copolymer having X percent by weight of units derived from PO and Y percent by weight of units derived from EO.
Diol is an initiator with 2 hydroxyl groups per molecule.
Triol is an initiator with 3 hydroxyl groups per molecule.

Table 2 provides the composition of Inventive Examples 1-5 and Comparative Examples 1-25.

TABLE 2

| Example | Base Oil | Wt %/PAG |
|---|---|---|
| Inventive Example 1 | SYNATIVE ES TMTC | 10%/DOWFAX 63N30 |
| Comparative Example 1 | SYNATIVE ES TMTC | NONE |

TABLE 2-continued

| Example | Base Oil | Wt %/PAG |
|---|---|---|
| Comparative Example 2 | SYNATIVE ES TMTC | 10%/SYNALOX 100-30B |
| Comparative Example 3 | SYNATIVE ES TMTC | 10%/SYNALOX 50-30B |
| Comparative Example 4 | SYNATIVE ES TMTC | 10%/SYNALOX 80-130B |
| Comparative Example 5 | SYNATIVE ES TMTC | 10%/DOWFAX 81N13 |

TABLE 2-continued

| Example | Base Oil | Wt %/PAG |
|---|---|---|
| Inventive Example 2 | CANOLA HILO + 0.25 wt % NALUBE AW 6110 | 10%/DOWFAX 63N30 |
| Comparative Example 6 | CANOLA HILO + 0.25 wt % NALUBE AW 6110 | NONE |
| Comparative Example 7 | CANOLA HILO + 0.25 wt % NALUBE AW 6110 | 10%/SYNALOX 100-30B |
| Comparative Example 8 | CANOLA HILO + 0.25 wt % NALUBE AW 6110 | 10%/SYNALOX 50-30B |
| Comparative Example 9 | CANOLA HILO + 0.25 wt % NALUBE AW 6110 | 10%/SYNALOX 80-130B |
| Comparative Example 10 | CANOLA HILO + 0.25 wt % NALUBE AW 6110 | 10%/DOWFAX 81N13 |
| Inventive Example 3 | SYMBIO PB-46 batch 1 + 0.25 wt % NALUBE AW 6110 | 10%/DOWFAX 63N30 |
| Comparative Example 11 | SYMBIO PB-46 batch 1 + 0.25 wt % NALUBE AW 6110 | NONE |
| Comparative Example 12 | SYMBIO PB-46 batch 1 + 0.25 wt % NALUBE AW 6110 | 10%/SYNALOX 100-30B |
| Comparative Example 13 | SYMBIO PB-46 batch 1 0.25 wt % NALUBE AW 6110 | 10%/SYNALOX 50-30B |
| Comparative Example 14 | SYMBIO PB-46 batch 1 + 0.25 wt % NALUBE AW 6110 | 10%/SYNALOX 80-130B |
| Comparative Example 15 | SYMBIO PB-46 batch 1 + 0.25 wt % NALUBE AW 6110 | 10%/DOWFAX 81N13 |
| Inventive Example 4 | Sunflower oil + 0.25 wt % NALUBE AW 6110 | 10%/DOWFAX 63N30 |
| Comparative Example 16 | Sunflower oil + 0.25 wt % NALUBE AW 6110 | NONE |
| Comparative Example 17 | Sunflower oil + 0.25 wt % NALUBE AW 6110 | 10%/SYNALOX 100-30B |
| Comparative Example 18 | Sunflower oil + 0.25 wt % NALUBE AW 6110 | 10%/SYNALOX 50-30B |
| Comparative Example 19 | Sunflower oil + 0.25 wt % NALUBE AW 6110 | 10%/SYNALOX 80-130B |
| Comparative Example 20 | Sunflower oil + 0.25 wt % NALUBE AW 6110 | 10%/DOWFAX 81N13 |
| Inventive Example 5 | Sunflower oil HILO + 0.25 wt % NALUBE AW 6110 | 10%/DOWFAX 63N30 |
| Comparative Example 21 | Sunflower oil HILO + 0.25 wt % NALUBE AW 6110 | NONE |
| Comparative Example 22 | Sunflower oil HILO + 0.25 wt % NALUBE AW 6110 | 10%/SYNALOX 100-30B |
| Comparative Example 23 | Sunflower oil HILO + 0.25 wt % NALUBE AW 6110 | 10%/SYNALOX 50-30B |
| Comparative Example 24 | Sunflower oil HILO + 0.25 wt % NALUBE AW 6110 | 10%/SYNALOX 80-130B |
| Comparative Example 25 | Sunflower oil HILO + 0.25 wt % NALUBE AW 6110 | 10%/DOWFAX 81N13 |

Each of Inventive Examples and Comparative Examples were made by blending the components at room temperature until a uniform mixture was obtained. Each of Inventive Examples and Comparative Examples were clear upon blending except for Comparative Examples 3, 8, 13, 18, and 23 (those containing SYNALOX 50-30B) which were all turbid.

Table 3 provides the results of hydrolytic stability testing on Inventive Examples 1-5 and Comparative Examples 1-25. This testing, as described below, provides total acid number (TAN) of the examples before and after exposure to water. The difference in TAN measurements before and after water exposure, ΔTAN, indicates the level of hydrolytic stability, wherein the smaller the ΔTAN, the greater the hydrolytic stability (i.e., indicating that exposure to water has not as severely increased the total acid number by hydrolysis).

TABLE 3

| Example | TAN before, mgKOH/g | TAN after, mgKOH/g | ΔTAN, mgKOH/g |
|---|---|---|---|
| Inventive Example 1 | 0.5 | 1.4 | 0.9 |
| Comparative Example 1 | 0.53 | 4.69 | 4.16 |
| Comparative Example 2 | 0.46 | 4.55 | 4.09 |
| Comparative Example 3 | 0.46 | 6.23 | 5.77 |
| Comparative Example 4 | 0.47 | 4.36 | 3.88 |
| Comparative Example 5 | 0.72 | 4.66 | 3.96 |
| Inventive Example 2 | 0.55 | 2.97 | 2.42 |
| Comparative Example 6 | 0.7 | 8.52 | 7.82 |
| Comparative Example 7 | 0.68 | 7.31 | 6.63 |
| Comparative Example 8 | 0.71 | 5.49 | 4.78 |
| Comparative Example 9 | 0.79 | 7.9 | 7.11 |
| Comparative Example 10 | 0.82 | 7.07 | 6.25 |
| Inventive Example 3 | 0.84 | 2.66 | 1.82 |
| Comparative Example 11 | 0.92 | 3.56 | 2.64 |
| Comparative Example 12 | 0.81 | 3.22 | 2.41 |
| Comparative Example 13 | 0.89 | 3.94 | 3.05 |
| Comparative Example 14 | 0.83 | 3.87 | 3.04 |
| Comparative Example 15 | 0.92 | 3.53 | 2.61 |
| Inventive Example 4 | 0.73 | 2.15 | 1.42 |
| Comparative Example 16 | 0.72 | 8.65 | 7.93 |
| Comparative Example 17 | 0.64 | 7.76 | 7.12 |
| Comparative Example 18 | 0.79 | 5.55 | 4.76 |
| Comparative Example 19 | 0.69 | 8.68 | 7.99 |
| Comparative Example 20 | 0.68 | 7.06 | 6.38 |
| Inventive Example 5 | 0.95 | 3.3 | 2.35 |
| Comparative Example 21 | 0.78 | 7.99 | 7.21 |
| Comparative Example 22 | 0.75 | 8.15 | 7.4 |
| Comparative Example 23 | 0.67 | 5.55 | 4.88 |
| Comparative Example 24 | 0.81 | 7.51 | 6.7 |
| Comparative Example 25 | 0.81 | 7.21 | 6.4 |

As can be seen from Table 3, in each of the ester base oils tested, DOWFAX 63N30, which is a 60 to 90/10 to 40 w/w PO/EO block copolymer showed significantly decreased hydrolysis, improved hydrolytic stability, in comparison to those ester base oils with no PAG additive or with PAG additives not meeting the specifications of the present inventive compositions.

No, or minor, beneficial effect was observed using the two random EO/PO copolymers (SYNALOX 80-130B and SYNALOX 50-30B) or the PO homo-polymer (SYNALOX 100-30B).

Inventive Examples 2-5 and Comparative Examples 6-25 further include 0.25 percent by weight of NALUBE AW 6110, an anti-wear additive. As previously mentioned, anti-wear additives tend to accelerate the hydrolytic degradation of esters. Anti-wear additives are commonly used in applications such as hydraulic fluids at low treat levels (0.1-0.5%). However, as seen from Table 3, even in the presence of the anti-wear additive, the Inventive Examples showed significant improvement over each of the Comparative Examples.

Table 4 illustrates the improvement in hydrolytic stability afforded at varying levels of DOWFAX 63N30, specifically at levels of 10 wt %, 5 wt % and 1 wt % in two natural Sunflower oil esters and two synthetic esters. As can be seen from Table 4, all levels tested exhibit improved hydrolytic stability.

Table 4 also shows the effect of adding DOWFAX 63N30 to a commercially available compressor lubricant (SSR Ultracoolant) that contains a PAG (homo-polymer of propylene oxide) and an ester. Improvements in hydrolytic stability are observed at 5, 2 and 1% addition of a block copolymer.

TABLE 4

| Example | Composition | ΔTAN, mgKOH/g |
|---|---|---|
| Comparative Example 26 | Sunflower Oil + NALUBE AW6110 (0.25%) | 7.9 |
| Inventive Example 6 | Sunflower Oil + NALUBE AW6110 (0.25%) + DOWFAX 63N30 (10%) | 1.4 |
| Inventive Example 7 | Sunflower Oil + NALUBE AW6110 (0.25%) + DOWFAX 63N30 (5%) | 2.8 |
| Inventive Example 8 | Sunflower Oil + NALUBE AW6110 (0.25%) + DOWFAX 63N30 (1%) | 5.8 |
| Comparative Example 27 | Sunflower Oil (HiLo) + NALUBE AW6110 (0.25%) | 7.2 |
| Inventive Example 9 | Sunflower Oil (HiLo) + NALUBE AW6110 (0.25%) + Dowfax 63N30 (10%) | 2.4 |
| Inventive Example 10 | Sunflower Oil (HiLo) + NALUBE AW6110 (0.25%) + Dowfax 63N30 (5%) | 3.8 |
| Comparative Example 28 | SYMBIO PB-46 batch 2 + NALUBE AW6110 (0.25%) | 7.8 |
| Inventive Example 11 | SYMBIO PB-46 batch 2 + NALUBE AW6110 (0.25%) + Dowfax 63N30 (10%) | 2.4 |
| Inventive Example 12 | SYMBIO PB-46 batch 2 + NALUBE AW6110 + (0.25%) + Dowfax 63N30 (5%) | 2.1 |
| Comparative Example 29 | SYNATIVE TMTC | 4.2 |
| Inventive Example 13 | SYNATIVE TMTC + Dowfax 63N30 (10%) | 0.9 |
| Inventive Example 14 | SYNATIVE TMTC + Dowfax 63N30 (5%) | 2.2 |
| Comparative Example 30 | SSR ULTRACOOLANT | 22.2 |
| Inventive Example 15 | SSR ULTRACOOLANT + Dowfax 63N30 (1%) | 11 |
| Inventive Example 16 | SSR ULTRACOOLANT + Dowfax 63N30 (2%) | 8.1 |
| Inventive Example 17 | SSR ULTRACOOLANT + Dowfax 63N30 (5%) | 8.1 |

Table 5 illustrates that the use of other PAG compositions meeting the structural requirements of the present invention also results in enhanced hydrolytic stability. Specifically, each of DOWFAX 63N10 and DOWFAX 100N15 are EO/PO block copolymers having a molecular weight in the range 1500 to 5000 g/mole, from 10 to 40 percent by weight of units derived from ethylene oxide and from 90 to 60 percent by weight of units derived from propylene oxide.

TABLE 5

| Example | Composition | ΔTAN, mgKOH/g |
|---|---|---|
| Comparative Example 31 | Sunflower Oil + NALUBE AW6110 (0.25 wt %) | 7.9 |
| Inventive Example 18 | Sunflower Oil + NALUBE AW6110 (0.25 wt %) + DOWFAX 63N10 (10 wt %) | 2.0 |
| Inventive Example 19 | Sunflower Oil + NALUBE AW6110 (0.25 wt %) + DOWFAX 100N15 (10 wt %) | 2.0 |

Tables 6 and 7 provide the solubility of different PAG structures at treat levels of 1, 5 and 10 weight percentages in a synthetic ester (SYNATIVE ES TMTC) and a natural ester (Sunflower HILO), respectively. As can be seen from Table 6, PAGs with an EO content of 40 wt % or higher are not soluble in the esters and form two layers on standing at ambient temperature. Hence, 40 wt % or greater EO PAGs have little practical value for use as ester base oil additives.

TABLE 6 using SYNATIVE TMTC

| PAG | Practical Molecular weight, g/mole | EO content (% wt) | PAG = 1% (w/w) | PAG = 5% (w/w) | PAG = 10% (w/w) |
|---|---|---|---|---|---|
| DOWFAX DF-117 | 4400 | | Clear | Clear | Clear |
| DOWFAX 63N10 | 1700 | ≥10, ≤40 | Clear | Clear | Clear |
| DOWFAX 81N10 | 2700 | ≥10, ≤40 | Clear | Clear | Clear |
| DOWFAX DF-111 | 4800 | | Clear | Clear | Clear |
| DOWFAX 81N15 | 2900 | ≥10, ≤40 | Clear | Clear | Clear |
| DOWFAX 92N20 | 3600 | ≥10, ≤40 | Clear | Vlear | Clear |
| PLURONIC RPE 2525 | unknown | ≥10, ≤40 | Clear | Clear | Clear |
| DOWFAX 63N30 | 2500 | ≥10, ≤40 | Clear | Clear | Clear |
| DOWFAX DF-114 | 4500 | | Clear | Clear | Clear |
| DOWFAX DF-112 | 3600 | | Clear | Clear | Clear |
| DOWFAX 63N40 | 2400 | ≥10, ≤40 | Clear | Turbid - 1 phase | 2 phases |
| DOWFAX 92N40 | 3600 | >40 | 2 phases | 2 phases | separates + solidifies |

TABLE 7 using Sunflower Oil HiLo

| PAG | Mol weight | EO content (% wt) | PAG = 1% (w/w) | PAG = 5% (w/w) | PAG = 10% (w/w) |
|---|---|---|---|---|---|
| DOWFAX 63N10 | 1700 | ≥10, ≤40 | Clear | Clear | Clear |
| DOWFAX 81N10 | 2700 | ≥10, ≤40 | Clear | Clear | Clear |
| DOWFAX DF-111 | 4800 | | Clear | Clear | Clear |
| DOWFAX 63N40 | 2400 | ≥10, ≤40 | 2 phases | 2 phases | 2 phases |
| DOWFAX 92N40 | 3600 | >40 | 2 phases | 2 phases | separates + solidifies |

Test Methods

Hydrolytic Stability

Hydrolytic stability was tested using a modified version of ASTM D2619, (Standard Test Method for Hydrolytic Stability of Hydraulic Fluids (Beverage Bottle Method)). ASTM D2619 stipulates that 25 percent by weight of water should be added to the lubricant. In preparing the data included herein, only 10 percent by weight water was used. In summary, the test proceeds as follows: (a) a sample of 90 g lubricant composition and 10 g of deionized water and a copper test coupon specimen are sealed in a pressure-type beverage bottle. The bottle is rotated, end over end, for 48 hours in an oven at 93° C. The oil and water layers are separated, and any insoluble material is weighed. The total acid number (TAN) of the fluid before and after the test is determined and the change reported.

Practical Molecular Weight

The practical molecular weight of each of the polymers was determined by measuring the hydroxyl content in accordance with ASTM D4274-D (Standard Test Methods for Testing Polyurethane Raw Materials: Determination of Hydroxyl Numbers of Polyols).

We claim:

1. A lubricant composition comprising:

(a) one or more ester base oils selected from the group of natural esters, synthetic esters and combinations thereof; and (b) from 3 to 8 percent by weight of one or more Diol initiated polyalkylene glycols (PAGs) based on the total weight of the Diol initiated PAG and ester base oil(s); and wherein the one or more Diol initiated PAGs have a molecular weight in the range 1500 to 5000 g/mole, comprise from 10 to 40 percent by weight of units derived from ethylene oxide and from 90 to 60 percent by weight of units derived from propylene oxide; and wherein the one or more Diol initiated PAGs are in the form of block copolymer, reverse block copolymer or combinations thereof.

2. The lubricant composition according to claim 1 wherein the one or more ester base oils is one or more natural esters selected from the group consisting of vegetable oils.

3. The lubricant composition according to claim 1 wherein the one or more ester base oils is one or more natural esters selected from the group consisting soy oil, canola oil, and sunflower oil.

4. The lubricant composition according to claim 1 wherein the one or more ester base oils include from greater than 0 to 100 percent by weight of ester derived from a renewable resource.

5. The lubricant composition according to claim 1 wherein the one or more esters is one or more synthetic esters selected from the group consisting of polyol esters and dicarbonic acid esters.

6. The lubricant composition according to claim 1 further comprising one or more selected from the group of antioxidants, anti-wear additives and corrosion inhibitors.

7. The lubricant composition according to claim 6 wherein the antioxidants are selected from the group consisting of phenolic antioxidants, hindered phenolic antioxidants, aromatic amine antioxidants, secondary amine antioxidants, sulfurized phenolic antioxidants, sulfurized olefins, oilsoluble copper compounds, and combinations thereof.

8. The lubricant composition according to claim 6 wherein the corrosion inhibitors are selected from the group consisting of (1) amine salts of an aliphatic phosphoric acid ester; (2) alkenyl succinic acid half esters; (3) amine salts of an alkyl phosphoric acid combined with a dithiophosphoric acid derivative; (4) combinations of barium dinonylnaphthalene sulfonate and dinonylnaphthalene carboxylate in a hydrotreated naphthenic oil; and (5) combinations thereof.

9. The lubricant composition according to claim 6 wherein the anti-wear additives are selected from the group consisting of zinc dialkyldithiophosphates, tricresyl phosphate, didodecyl phosphite, sulfurized sperm oil, sulfurized terpenes, zinc dialkyldithiocarbamate, and combinations thereof.

10. The lubricant composition according to claim 1 wherein the one or more PAGs each have a molecular weight from 1700 to 3300 g/mole.

11. The lubricant composition according to claim 1 wherein the one or more Diol initiated PAGs are present in an amount from 5 to 8 percent by weight.

12. The lubricant composition according to claim 1 wherein the one or more PAGs has an amount of units derived from EO from 20 to 40 percent by weight.

13. A method of enhancing the hydrolytic stability of an ester based lubricant comprising:

(a) providing an ester base oil;

(b) adding to the ester base oil from 3 to 8 percent by weight one or more Diol initiated PAGs based on the total weight of the one or more Diol initiated PAGs and ester base oil; wherein the one or more Diol initiated PAGs have a molecular weight in the range 1500 to 5000 g/mole, comprise from 10 to 40 percent by weight of units derived from ethylene oxide and from 90 to 60 percent by weight of units derived from propylene oxide; and wherein the one or more Diol initiated PAG is in the form of block copolymer, reverse block copolymer or combinations thereof; and (c) blending the one or more Diol initiated PAGs to form a lubricant composition.

14. The method according to claim 13 further comprising adding one or more additives selected from the group consisting of antioxidants, anti-wear additives and corrosion inhibitors to the lubricant composition.

15. The method according to claim 13 wherein the one or more Diol initiated PAGs are added in an amount from 5 to 8 percent by weight one or more Diol initiated PAGs based on the total weight of the Diol initiated PAG and ester base oil.

* * * * *